US012607018B2

(12) United States Patent
Fan et al.

(10) Patent No.: US 12,607,018 B2
(45) Date of Patent: Apr. 21, 2026

(54) SYNCHRONOUS ROTATING TELESCOPIC LOUVER ROOF TENT AND SERVO ELECTRIC DRIVE OPENING AND CLOSING TENT

(71) Applicant: Zhejiang Yotrio Group Co., Ltd., Linhai (CN)

(72) Inventors: Shunqin Fan, Linhai (CN); Jianqiang Xie, Linhai (CN)

(73) Assignee: Zhejiang Yotrio Group Co., Ltd., Linhai (CN)

( * ) Notice: Subject to any disclaimer, the term of this patent is extended or adjusted under 35 U.S.C. 154(b) by 245 days.

(21) Appl. No.: 18/269,607

(22) PCT Filed: Apr. 21, 2023

(86) PCT No.: PCT/CN2023/089794
§ 371 (c)(1),
(2) Date: Jun. 26, 2023

(87) PCT Pub. No.: WO2024/037018
PCT Pub. Date: Feb. 22, 2024

(65) Prior Publication Data

US 2024/0384537 A1 Nov. 21, 2024

(30) Foreign Application Priority Data

Aug. 18, 2022 (CN) ..... 202222169914.3

(51) Int. Cl.
*E04F 10/10* (2006.01)

(52) U.S. Cl.
CPC ..... *E04F 10/10* (2013.01)

(58) Field of Classification Search
CPC ..... E04F 10/08; E04F 10/10; E06B 7/163
See application file for complete search history.

(56) References Cited

U.S. PATENT DOCUMENTS 10,094,122 B1 * 10/2018 Akbulut ..... E04B 7/163
2014/0130988 A1 * 5/2014 Frigerio ..... E04B 7/166 160/161

(Continued)

FOREIGN PATENT DOCUMENTS

CN 202140002 U * 2/2012
CN 102518382 A * 6/2012

(Continued)

OTHER PUBLICATIONS

China National Intellectual Property Administration, International Search Report, Application No. PCT/CN2023/089794, Mailed Jun. 13, 2023, 6 pages.

*Primary Examiner* — Beth A Stephan
(74) *Attorney, Agent, or Firm* — Ziegler IP Law Group, LLC.

(57) ABSTRACT

A tent includes foot tubes, and long ring beams and short ring beams supported by the foot tubes and defining a roof cavity of the tent. The tent further includes louver blades each have two ends; end covers fitted with the two ends of the louver blades; and connecting sheets hinged with the end covers, respectively, to drive the louver blades to rotate. Wherein when the end covers and the connecting sheets cooperate to expand, the louver blades rotate to expand horizontally to complete covering of the roof cavity, and wherein when the end covers and the connecting sheets cooperate to contract, the louver blades rotate to contract horizontally toward one of the two short ring beams.

17 Claims, 8 Drawing Sheets

(56) References Cited

U.S. PATENT DOCUMENTS

| | | | | |
|---|---|---|---|---|
| 2018/0100310 | A1* | 4/2018 | Sprotofski | E04F 10/10 |
| 2019/0128055 | A1* | 5/2019 | Badenhorst | E06B 9/322 |
| 2019/0186149 | A1* | 6/2019 | Ji | E06B 7/086 |
| 2021/0355685 | A1* | 11/2021 | Terenzi | E04F 10/10 |
| 2022/0120088 | A1* | 4/2022 | Byszenski | E04B 7/166 |
| 2023/0417060 | A1* | 12/2023 | Hong | E04F 10/10 |

FOREIGN PATENT DOCUMENTS

| | | | | | |
|---|---|---|---|---|---|
| CN | 103114798 | A | * | 5/2013 | |
| CN | 109594802 | A | * | 4/2019 | E04F 10/04 |
| CN | 110886533 | A | | 3/2020 | |
| CN | 111794457 | A | | 10/2020 | |
| CN | 112854883 | A | | 5/2021 | |
| CN | 218522083 | U | * | 2/2023 | E04F 10/10 |
| KR | 102068117 | | * | 1/2020 | |
| KR | 102406296 | | * | 6/2022 | |

* cited by examiner

SYNCHRONOUS ROTATING TELESCOPIC LOUVER ROOF TENT AND SERVO ELECTRIC DRIVE OPENING AND CLOSING TENT

FIELD OF TECHNOLOGY

The present invention belongs to the technical field of sunshade supplies, and in particular to a synchronous rotating telescopic louver roof tent and a servo electric driving opening and closing tent.

BACKGROUND TECHNOLOGY

In order to meet demands for existing outdoor awning products, a variety of awnings have appeared on the market, such as sunrooms with fixed roofs. This type of awning cannot realize the folding of a roof of the awning, and its use is limited. Another kind of traditional fixed flipping louver roof sun room with a single function can only realize flipping of louver blades, but cannot realize expansion and contraction of the louver blades, which cannot obtain an effect that the customer get close to nature with direct sunlight and full open air without shelter.

To this end, disclosed, such as in the document with publication number CN110886533B, is a louver awning, comprising an awning frame and a group of louver blades, wherein the awning frame comprises at least two louver awning beams and at least two columns, the columns are provided with transmission mechanisms, the louver awning beams are provided with flipping apparatuses, the transmission mechanisms control flipping of the flipping apparatuses through linkage parts, and the group of the louver blades can be flipped. Chain transmission is used to realize a flipping structure of the louver blades, but it cannot realize a partial open roof structure.

In addition, disclosed, such as in CN111794457B, is a tent with a long, center-driven louver roof opening and closing structure. For example, CN112854883A discloses an outdoor louver tent with a roof that can be combined and expanded, but it is also unable to obtain the effect that the customer get close to nature with direct sunlight and full open air without shelter.

The existing structures have the following disadvantages: 1. The line of sight is blocked, adjustable range is small, and visibility is limited when it is fully opened; 2. The installation is complex for the customer, which needs to install the louver plates on the rotating part one by one, and pipes on both sides of the louver plate are not common, so the customer needs to identify the direction of the louver plate first, otherwise it is easy to reverse the installation; 3. Due to process limitations, the pipes of the louver plates are prone to distortion and deformation, which leads to functional disorders such as incomplete closure of the louver plates in an closed state; 4. In addition, in the existing electric driving louver roof opening and closing structure, a unidirectional output motor is usually used to achieve power output, which leads a problem of the dislocation of the opening and closing of the louvers because the synchronization rate is easy to be poor when the louver plates transmit synchronously on both sides.

SUMMARY OF THE INVENTION

Aiming at the problems existing in the prior art, the present invention is designed to provide a synchronous rotating telescopic louver roof tent and a servo electric driving opening and closing tent to solve the above technical problems. It has the characteristics of a simple structure, a large open surface of the roof, a simple and practical linkage structure and stable synchronous linkage of the louver plates.

The technical problem solved by the present invention may be implemented by the following technical solution:

A synchronous rotating telescopic louver roof tent, comprising foot tubes, and long ring beams and short ring beams arranged in upper parts of the foot tubes, wherein the long ring beams and the short ring beams are combined to form a roof cavity of the tent, louver roof components are installed in the roof cavity of the tent, the louver roof components comprise louver blades, end covers fitted with both ends of the louver blades and connecting sheets hinged with the end covers, wherein a plurality of end covers cooperate with a plurality of connecting sheets installed corresponding to the plurality of end covers so as to form a telescopic linkage and to drive the corresponding installed louver blades to flip; when the end covers and the connecting sheets cooperate to realize expansion, a plurality of louver blades in the louver roof components gradually expand horizontally to complete covering of the roof cavity of the tent; and when the end covers and the connecting sheets cooperate to realize contraction, the plurality of louver blades in the louver roof components gradually flip towards a vertical direction and contract to one ends.

Further, the end covers are hinged with middle parts of the connecting sheets so as to form collapsible cross structures.

Further, the end covers and the middle parts of the connecting sheets are provided with assembly holes, and rotating shafts penetrate through the assembly holes so that the end covers and the connecting sheets match in a hinged form.

Further, each of the end covers is arranged in a Z shape.

Further, the rotating shaft are further matched with rollers, the rollers are used to be in slide fit with chutes, and the chutes are located on side walls of the long ring beams.

Further, one ends of the louver roof components are fixed ends, and the other ends of the louver roof components are free ends, and the louver blades at the free ends are capable of being gradually close to or far away from the fixed ends through telescopic matching of the end covers and the connecting sheets.

Further, the tent further comprises transmission members and the transmission members are used to linkage the end covers and the connecting sheets so as to achieve telescopic movement.

Further, each of the transmission members adopts any one of a synchronous belt, a chain, a screw rod, a linkage rod, and a rack.

Further, the transmission members are driven by a hand worm, a motor, or a gas rod.

A servo electric driving opening and closing tent, wherein the tent combines the above-mentioned synchronous rotating telescopic louver roof tent and further comprises a motor driving mechanism.

Further, the motor driving mechanism comprises a servo control motor, the servo control motor comprises a first driving end and a second driving end, wherein the first driving end is used to cooperate with the first driving component, the second driving end is used to cooperate with the second driving component, and the first driving end and the second driving end are synchronous transmission.

Further, the first driving component comprises a first transmission shaft and a first louver synchronous transmission mechanism, the second driving component comprises a second transmission shaft and a second louver synchronous transmission mechanism, wherein the first louver synchronous transmission mechanism and the second louver synchronous transmission mechanism respectively cooperate with two long ring beams.

Further, the servo control motor is installed on a short ring beam through a motor support, the servo control motor is centrally arranged, and the first driving component and the second driving component are symmetrically arranged with respect to the servo control motor.

Further, the tent further comprises a rain sensor, wherein the rain sensor is used to collect rain information, and transmit a collected signal to a controller of the servo control motor, and the controller drives the servo control motor according to the signal transmitted by the rain sensor, so as to realize the closing of the roof of the tent.

Further, the first transmission shaft and the second transmission shaft are coaxially arranged along the short ring beams, and the servo control motor is installed on a short ring beam at an adjacent fixed end through the motor support.

Further, the first louver synchronous transmission mechanism and the second louver synchronous transmission mechanism adopt the same structure which comprises a driving wheel, a slave wheel and a synchronous belt, and the synchronous belt moves with the rotation of the driving wheel.

Further, the driving wheels are installed in the long ring beams adjacent to the fixed ends through driving wheel seats, the slave wheels are installed in the long ring beams adjacent to the free ends through slave wheel seats, the synchronous belts are coaxially arranged along the long ring beams, the synchronous belts are installed through rotating seats and the rotating shafts in the louver blades, the rotating seats drive the louver blades with the movement of the synchronous belts to realize synchronous contraction for flipping or expansion for coverage.

Further, the driving wheel seats are provided with driving wheel cavities, the driving wheel cavities are used to install the driving wheels, upper parts of the driving wheel cavities are further provided with anti-jump tooth parts, the anti-jump tooth parts are provided with limit plates, the limit plates are covered with upper parts of the synchronous belts cooperating with the driving wheels in transmission.

Further, the first transmission shaft is installed in cooperation with the driving wheel in the first louver synchronous transmission mechanism through a first synchronous shaft, the first transmission shaft drives the first synchronous shaft to rotate, the first synchronous shaft drives the driving wheel in the first louver synchronous transmission mechanism to rotate; and the second transmission shaft is installed in cooperation with the driving wheel in the second louver synchronous transmission mechanism through a second synchronous shaft, the second transmission shaft drives the second synchronous shaft to rotate, the second synchronous shaft drives the driving wheel in the second louver synchronous transmission mechanism to rotate.

The present invention has the following beneficial effects compared to the prior art: in the present invention, the arrangement of the louver roof components is optimized, which can realize the expansion and contraction of the louver. In the process of expansion and contraction, the louver blades rotate and are closed to achieve the effect of sheltering from the sun and rain; when the louver blades are expanded and opened, it can be completely open without shielding direct light, greatly improve the lighting effect, and meet the needs of large area lighting of users; adjacent louver blades are connected end to end around a rotation axis thereof by a single independent connecting sheet so as to achieve effects of overall linkage, convenient assembly and simple operation; by optimizing a servo control motor with double-end output structure and combining a first driving component and the second driving component to synchronously drive the linkage of the two ends of the louver blades, the stability of the opening and closing motion of the louver blades is improved; the setting of servo control motor is preferred to realize the transmission precision of power output, improve the transmission stability and the opening and closing positioning control; and, at the same time, it is equipped with the rain sensor, which can realize the control of closing by rain sensing, improve the intelligence of the closing and starting of louver blades in the louver tent, and increase the sense of user experience.

The characteristics of the present invention can be clearly understood by referring to the detailed descriptions of the drawings and the following embodiments.

Figure 1:
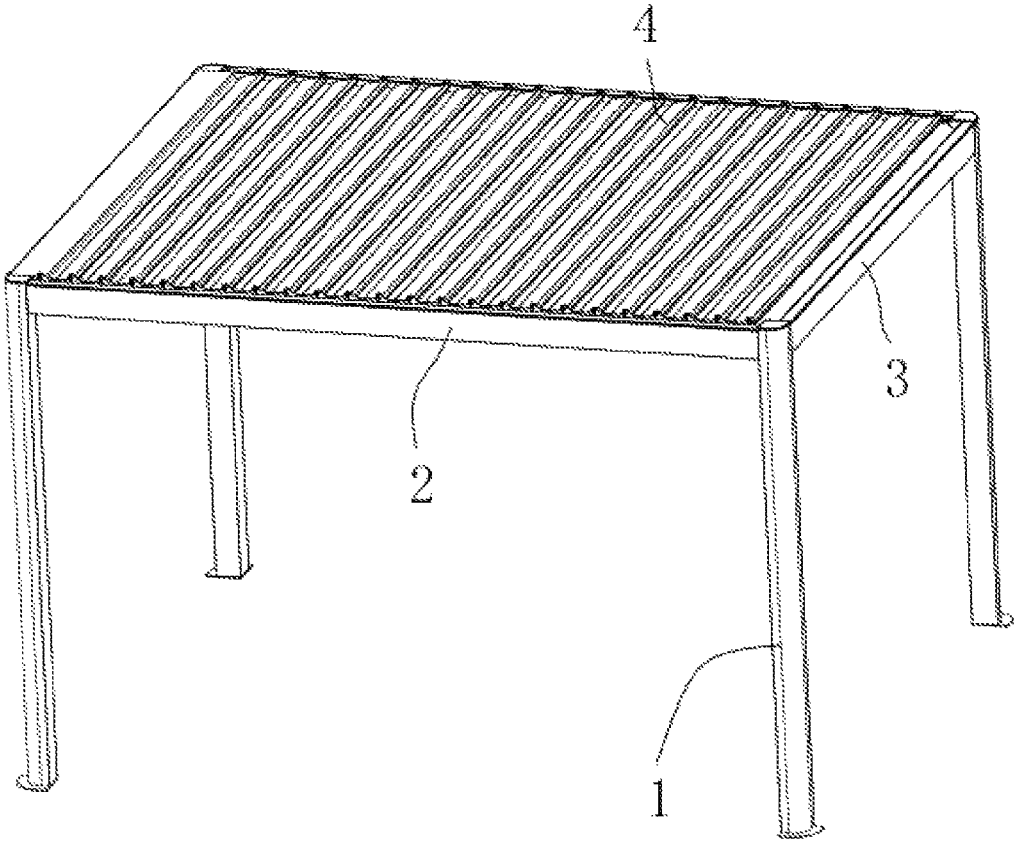
FIG. 1 is an overall structure diagram of the present invention.
Figure 2:
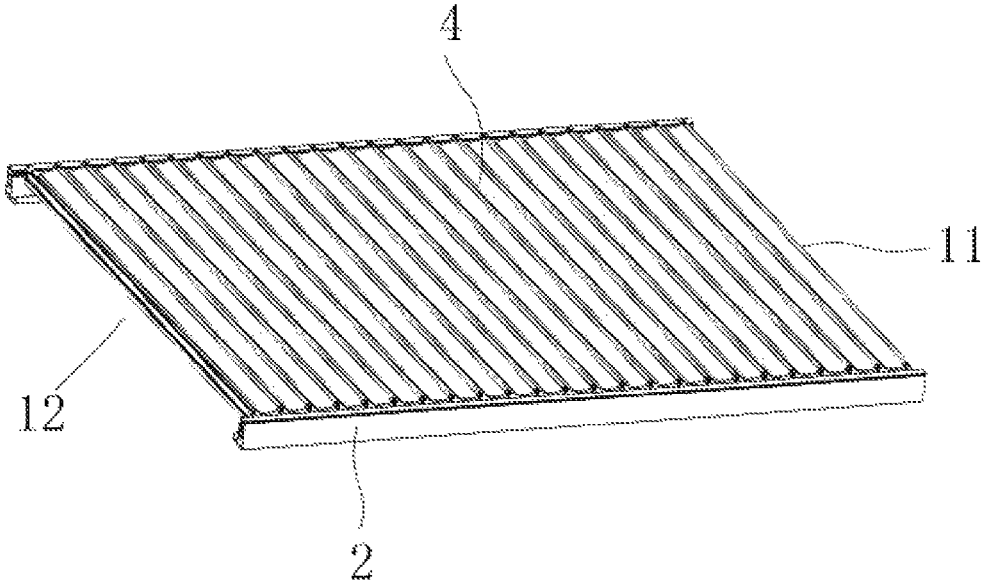
FIG. 2 is a schematic structural diagram of louver blades of a tent roof in a completely closed covering state in the present invention.
Figure 3:
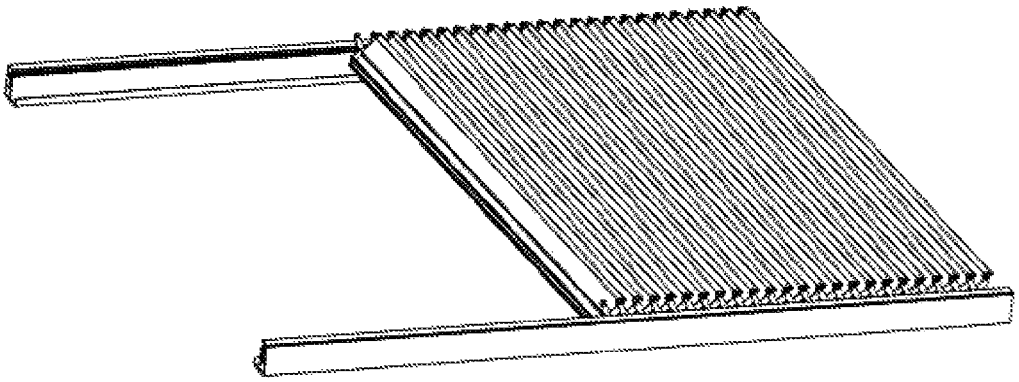
FIG. 3 is a schematic structural diagram of the louver blades of the tent roof in case of partial contraction in the present invention.
Figure 4:
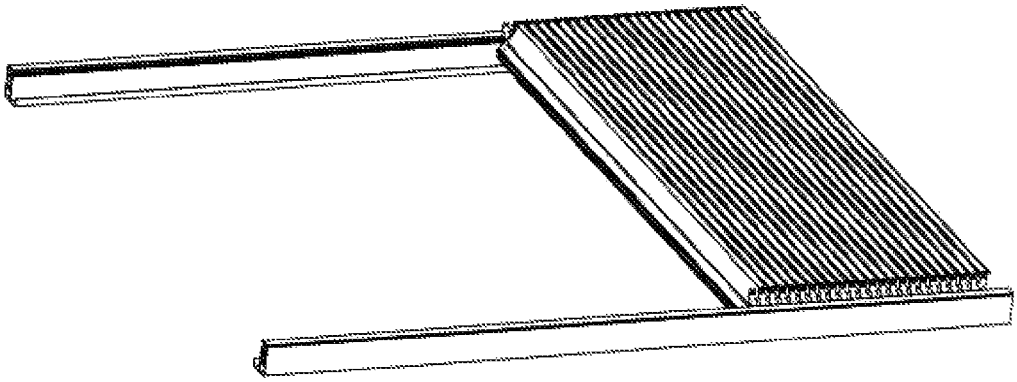
FIG. 4 is a schematic structural diagram of the louver blades of the tent roof in case of complete contraction in the present invention.
Figure 5:
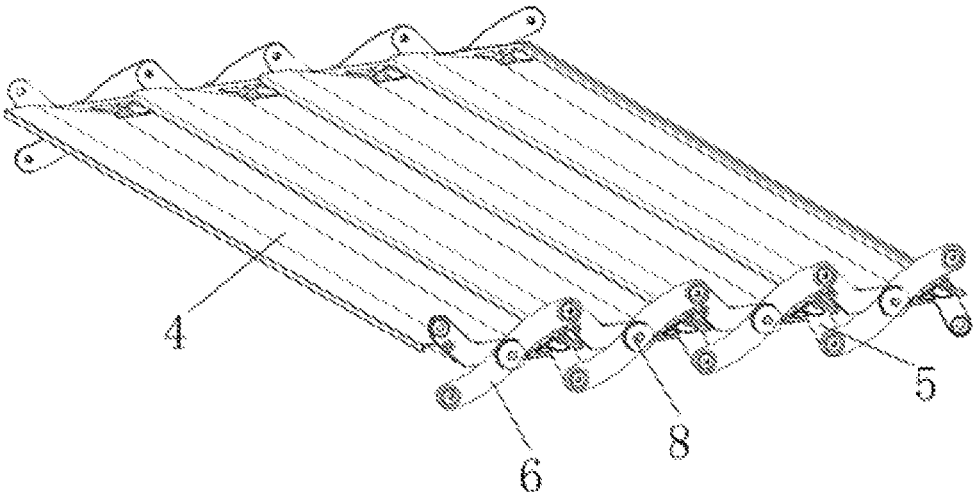
FIG. 5 is a schematic diagram of an assembly structure of the louver blades, end covers and connecting sheets in the present invention.
Figure 6:
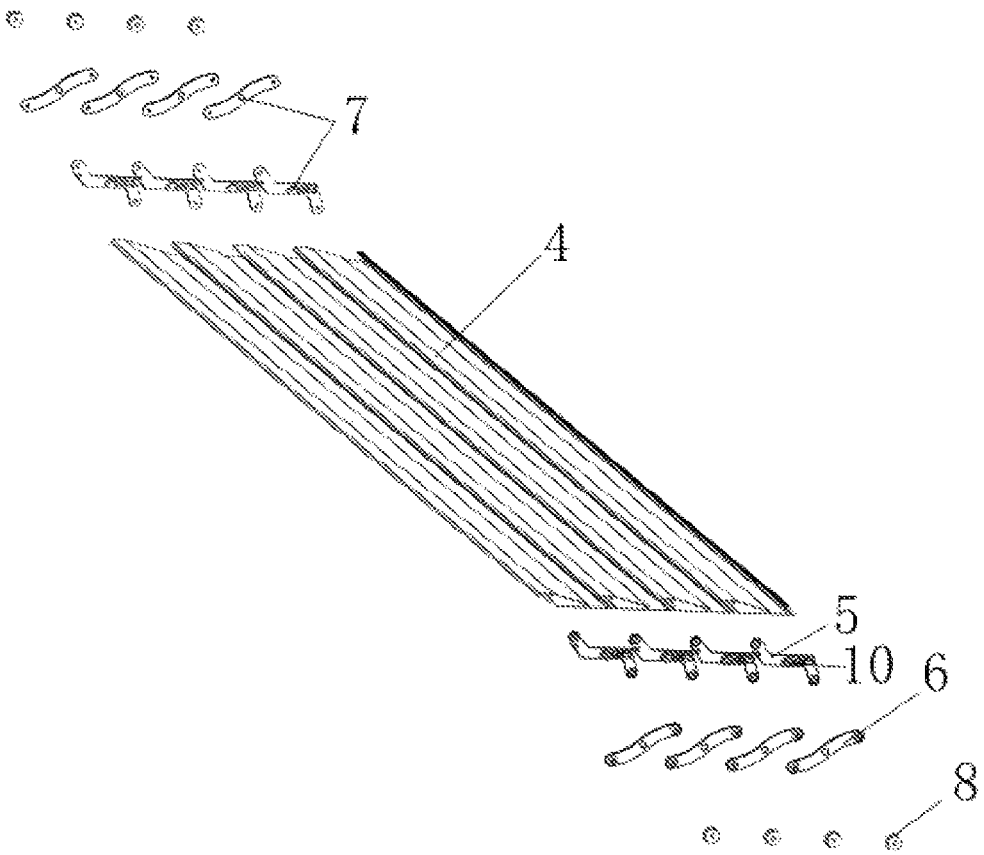
FIG. 6 is a schematic diagram of a disassembly structure of the louver blades, end covers and connecting sheets in the present invention.
Figure 7:
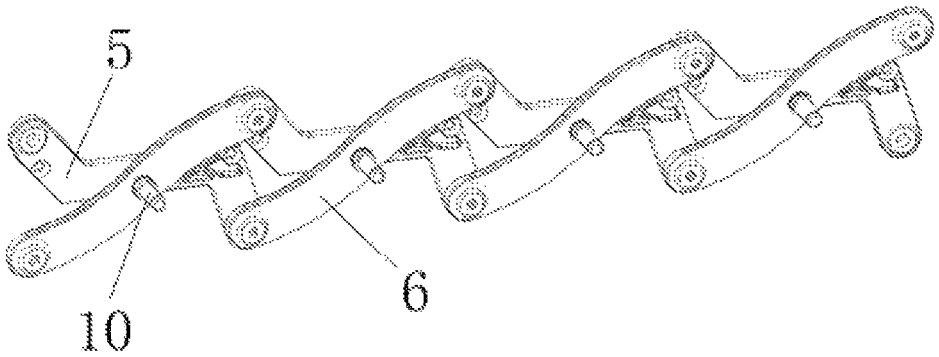
FIG. 7 is a schematic diagram of an assembly structure of the end covers and connecting sheets in the present invention.
Figure 8:
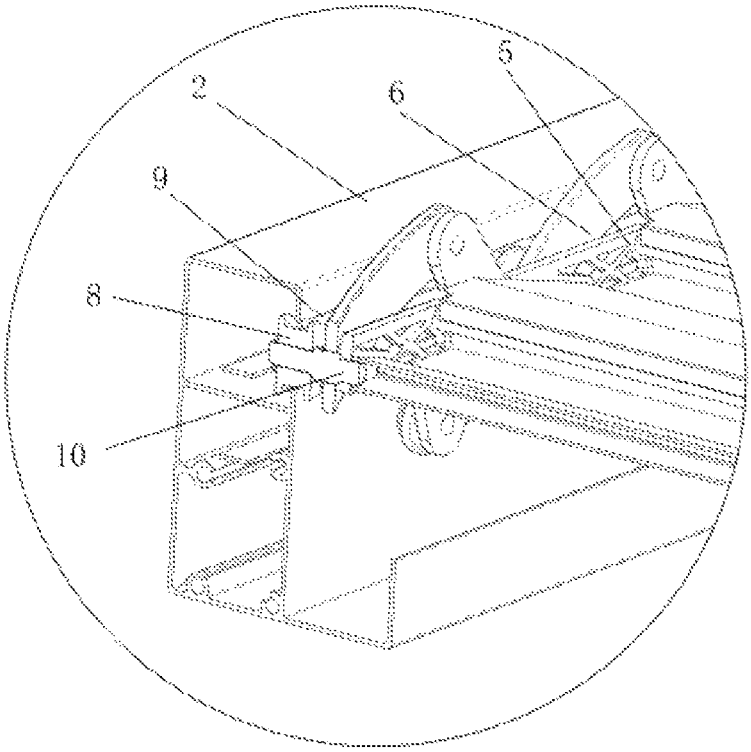
FIG. 8 is a schematic diagram of an installation structure of a roller and a long ring beam in the present invention.
Figure 9:
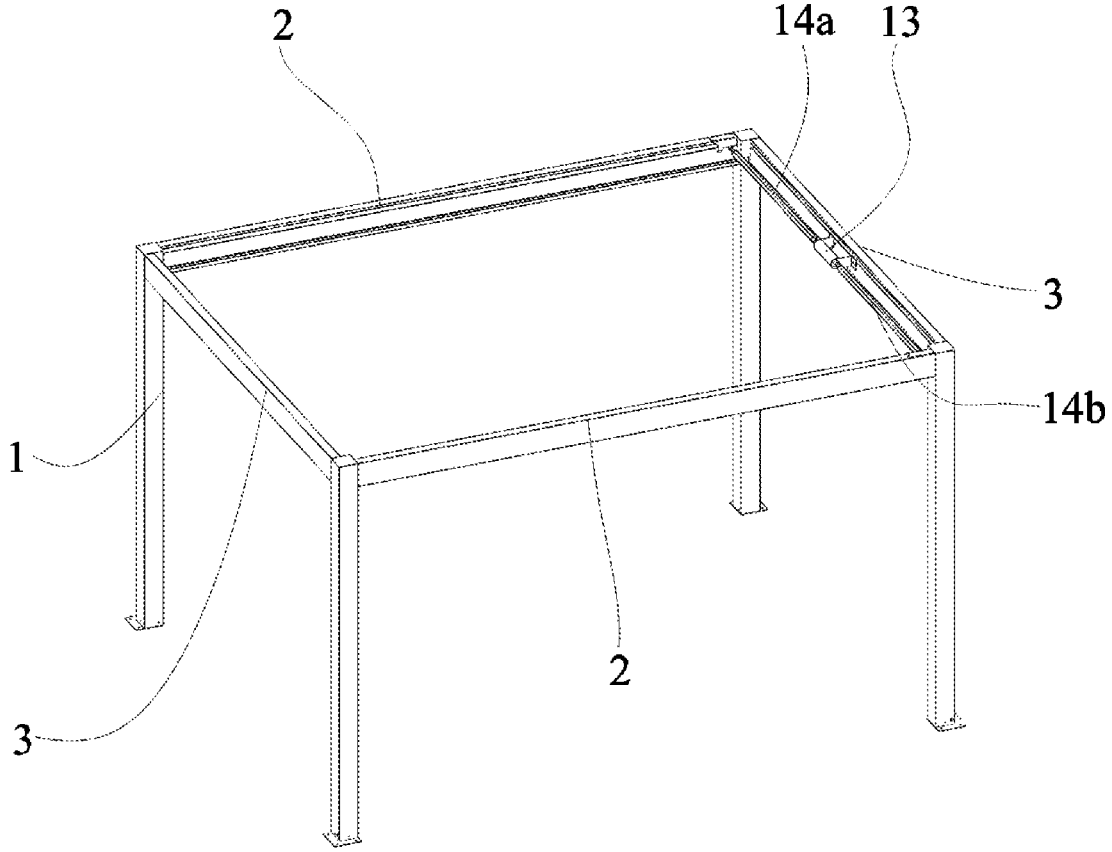
FIG. 9 is a schematic diagram of an installation structure of a motor driving mechanism in the present invention.

Wherein, 1—foot tube, 2—long ring beam, 3—short ring beam, 4—louver blade, 5—end cover, 6—connecting sheet, 7—assembly hole, 8—roller, 9—chute, 10—rotating shaft, 11—fixed end, 12—free end, 13—servo control motor, 13*a*—first driving end, 13*b*—second driving end, 14*a*—first transmission shaft, 14*b*—second transmission shaft, 15*a*—first synchronous shaft, 15*b*—second synchronous shaft, 16—motor support, 17—driving wheel, 18—synchronous belt, 19—driving wheel seat, 20—anti-jump tooth part, 21—limit plate, 22—slave wheel, 23—slave wheel seat, 24—rotating seat, 25—rain sensor.

DESCRIPTION OF THE EMBODIMENTS

In order to make the technical means, creative features, achieved objectives and effects easy to be understood, the present invention will be further elaborated by combining the specific drawings.

Example 1

As shown in FIG. 1 to FIG. 8, disclosed in the present invention is a synchronous rotating telescopic louver roof tent, which comprises foot tubes 1, and long ring beams 2 and short ring beams 3 arranged in upper parts of the foot tubes 1, wherein the long ring beams 2 and the short ring beams 3 are combined to form a roof cavity of the tent, louver roof components are installed in the roof cavity of the tent. When the louver roof components only rotate without expansion or contraction and are fully expanded, it is convenient to shield sunlight and realize full shielding of sunlight at the roof. When the louver roof components only rotate without expansion or contraction and are half unfolded, partial shielding of sunlight is realized, and a gap between the adjacent louver blades is used for part of the sunlight to pass through. When the louver roof components rotates with expansion or contraction, the louver blades can be collected to one ends of the short ring beams, so as to achieve full open air without shelter.

Continue to refer to FIG. 5 to FIG. 8, the louver roof components comprise louver blades 4, Z shape end covers 5 fixed with both ends of the louver blades 4 and connecting sheets 6 hinged with the end covers 5. More specifically, the end covers 5 are hinged with middle parts of the connecting sheets 6 so as to form collapsible cross structures; the end covers 5 and the middle parts of the connecting sheets 6 are provided with assembly holes 7, and rotating shafts 10 penetrate through the assembly holes 7 so that the end covers 5 and the connecting sheets 6 match in a hinged form; and the rotating shaft 10 are further matched with rollers 8, the rollers 8 are used to be in slide fit with chutes 9, and the chutes 9 are located on side walls of the long ring beams 2 and used in cooperation with the rollers 8.

More specifically, one end hole of the connecting sheet 6 is hinged with a head hole of end cover 5 of a previous louver blade, and the other end hole is hinged with a tail hole of end cover 5 of a next louver blade. The end cover 5 and an assembly hole of the connecting sheet 6 are set in an X shape after connecting by the rotating shaft 10. The setting can realize the rotation for opening and closing of the louver through the parallelogram principle. A plurality of end covers 5 cooperate with a plurality of connecting sheets 6 installed corresponding to the plurality of end covers 5 so as to form a telescopic linkage and to drive the corresponding installed louver blades to flip; when the end covers 5 and the connecting sheets 6 cooperate to realize expansion, a plurality of louver blades 4 in the louver roof components gradually expand horizontally to complete covering of the roof cavity of the tent; and when the end covers 5 and the connecting sheets 6 cooperate to realize contraction, the plurality of louver blades 4 in the louver roof components gradually flip towards a vertical direction and contract to one ends. The louver blades 4 in the roof of the louver can be expanded and contracted flexibly. One ends of the louver roof components are fixed ends 11, and the other ends of the louver roof components are free ends 12. The louver blades 6 at the free ends 12 can be gradually close to or far away from the fixed ends 11 through telescopic matching of the end covers 5 and the connecting sheets 6. The louver roof components also comprise a transmission member, which is used to link the end cover and the connecting sheet to achieve telescopic movement. The transmission member adopts any one of a synchronous belt, a chain, a screw rod, a linkage rod and a rack. It can also be driven by a hand worm, a motor, or a gas rod.

For the tent in the present invention, the expansion and contraction of the louver blades 4 in the roof of tent can be realized. In the process of expansion and contraction, the louver blades rotate and are closed to achieve the effect of sheltering from the sun and rain; the louver blades can be opened and closed either manually or electrically; and, when the louver blades are expanded and opened, it can be completely open without shielding direct light, greatly improve the lighting effect, and meet the needs of large area lighting of users. Therefore, the flexibility of use is improved.

Example 2

Based on Example 1, combined with FIG. 9 to FIG. 16, disclosed in this example is a servo electric driving opening and closing tent, which combines a synchronous rotating telescopic louver roof tent in Example 1 and further comprises a motor driving mechanism. By optimizing a servo control motor 13 with double-end output structure and combining a first driving component and the second driving component to synchronously drive the linkage of the two ends of the louver blades 4, the stability of the opening and closing motion of the louver blades 4 is improved; the setting of servo control motor 13 is preferred to realize the transmission precision of power output, improve the transmission stability and the opening and closing positioning control; and, at the same time, it is equipped with the rain sensor 25, which can realize the control of closing by rain sensing, improve the intelligence of the closing and starting of louver blades 4 in the louver tent, and increase the sense of user experience.

In a specific structure, the motor driving mechanism comprises the servo control motor 13. It is preferred to use the servo control motor 13, which can realize good precision control and make the whole driving structure more stable and accurate. The servo control motor 13 comprises a first driving end 13*a* and a second driving end 13*b*, wherein the first driving end 13*a* is used to cooperate with the first driving component, the second driving end 13*b* is used to cooperate with the second driving component. The first driving end 13*a* and the second driving end 13*b* are synchronous transmission. The servo control motor 13 with a double-end driving structure is used to synchronize the flipping of both sides of the louver blades 4 in the louver roof component in the roof of tent, which makes the transmission of expansion or contraction for opening or closing of the louver blades 4 more stable and effective.

Specifically, the first driving component comprises a first transmission shaft 14*a* and a first louver synchronous transmission mechanism, the second driving component comprises a second transmission shaft 14*b* and a second louver synchronous transmission mechanism, wherein the first louver synchronous transmission mechanism and the second louver synchronous transmission mechanism respectively cooperate with two long ring beams 2. In the specific installation structure, the first transmission shaft 14*a* and the second transmission shaft 14*b* are set corresponding to each other according to the installation position of the servo control motor 13. They can be the same structure and set symmetrically, or they can be different structures and set independently, so as to realize the synchronous transmission operation.

Combined with the above, in a preferred example, the servo control motor 13 is installed on a short ring beam 3 through a motor support 16; the servo control motor 13 is set in the center; the first driving component and the second driving component are set symmetrically with the servo control motor 13 as the center; the first transmission shaft 14*a* and the second transmission shaft 14*b* are coaxially arranged along the short ring beams 3; the first transmission shaft 14*a* and the second transmission shaft 14*b* are arranged symmetrically; the servo control motor 13 is installed on a short ring beam 3 at an adjacent fixed end through the motor support 16; the first louver synchronous transmission mechanism and the second louver synchronous transmission mechanism adopt the same structure which comprises a driving wheel 17, a slave wheel 22 and a synchronous belt 18, and the synchronous belt 18 moves with the rotation of the driving wheel 17; and, it is preferred to use the symmetrical structure design, which is conducive to the synchronization of the two ends and the transmission of the louver blades 4 in the louver roof components in the power transmission process, and improves the transmission stability.

In a specific structure, the driving wheels 17 are installed in the long ring beams 2 adjacent to the fixed ends 11 through driving wheel seats 19; the slave wheels 22 are installed in the long ring beams 2 adjacent to the free ends 12 through slave wheel seats 23; the synchronous belts are coaxially arranged along the long ring beams 2; the two ends of the louver blades 4 in the louver roof components are hinged and matched with the corresponding rotating seats 24 on the synchronous belts 18 by rotating axis 10 in turn; the synchronous belts 18 are installed through rotating seats 24 and the rotating shafts 10 in the louver blades 4, so that the synchronous belts 18 drive the louver blades 4 to move; and the rotating seats 24 drive the louver blades 4 with the movement of the synchronous belts 18 to realize synchronous contraction for flipping or expansion for coverage.

Figure 10:
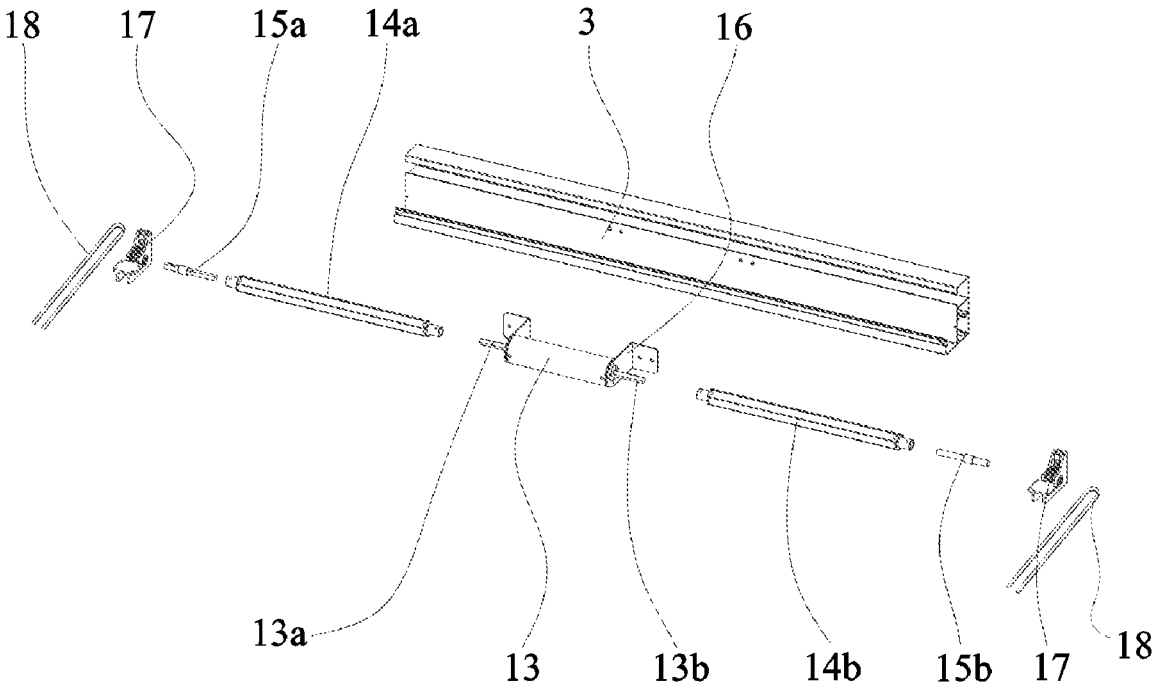
FIG. 10 is a schematic diagram of a disassembly structure of the motor driving mechanism of the tent in the present invention.
Figure 11:
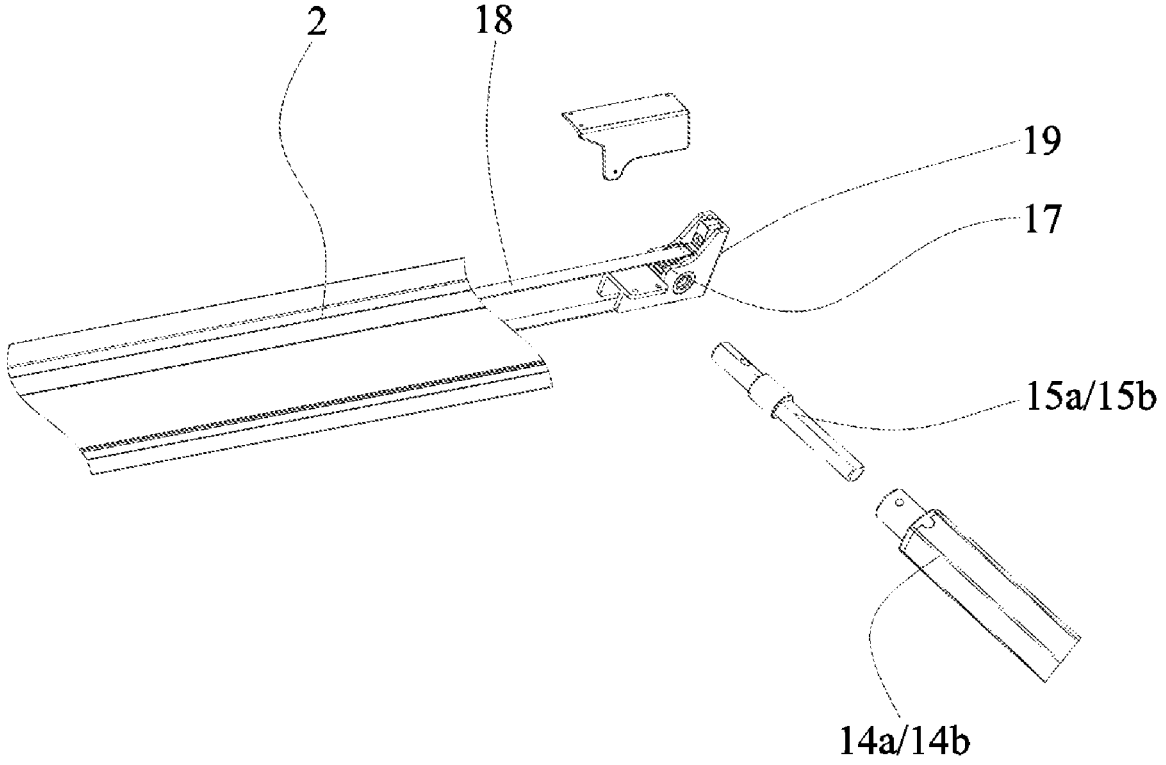
FIG. 11 is a schematic diagram of an installation structure of a first driving component or a second driving component in the present invention.
Figure 12:
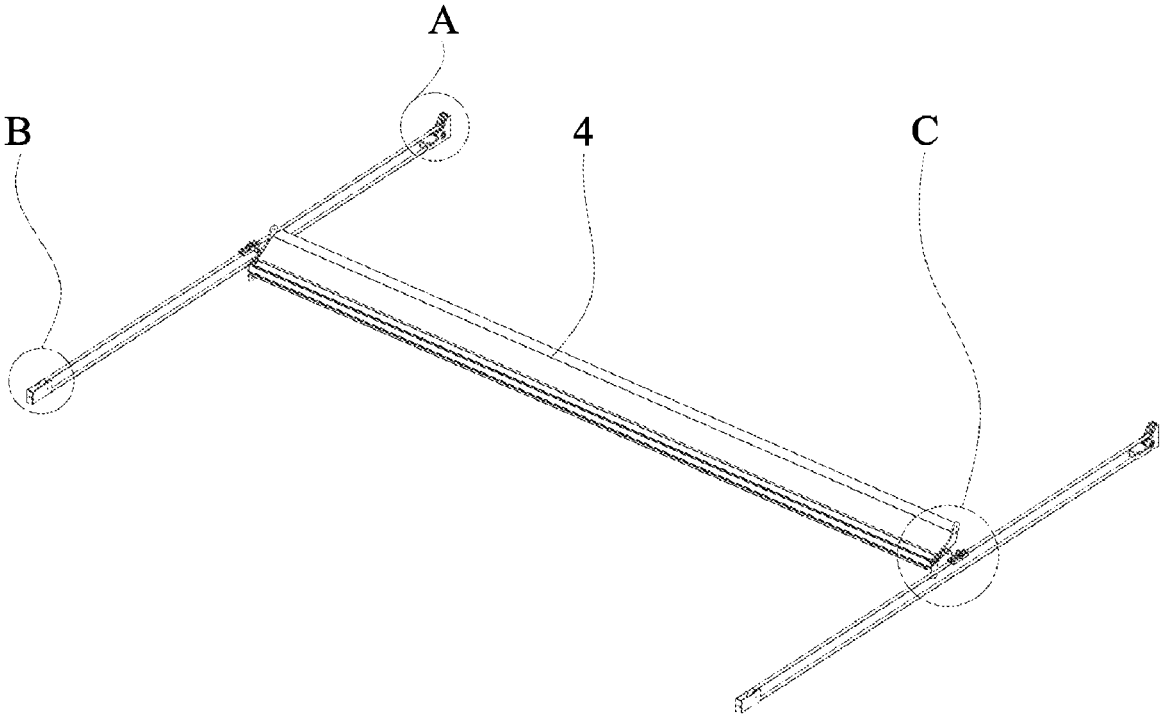
FIG. 12 is a schematic diagram of an installation structure of louver blade transmission in the present invention.
Figure 13:
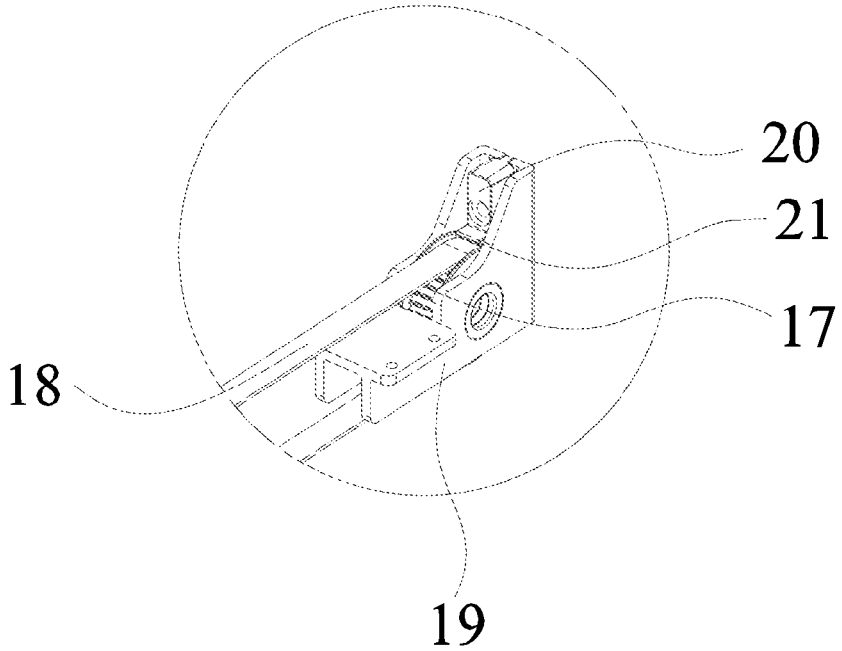
FIG. 13 is a schematic diagram of a partial enlarged structure at part A in FIG. 12.
Figure 14:
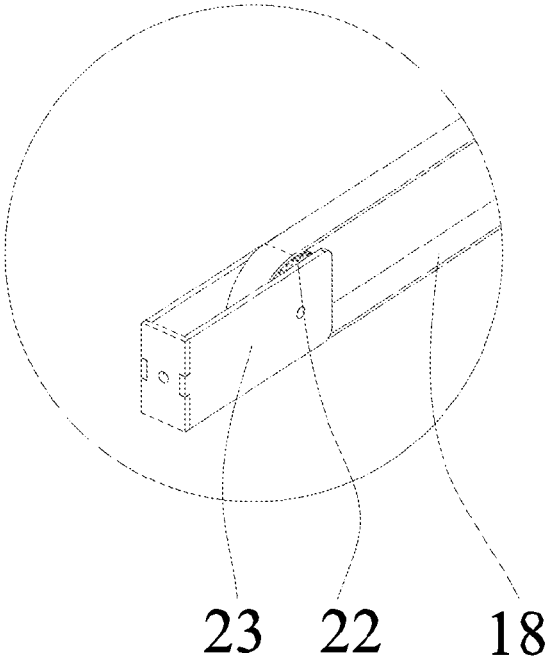
FIG. 14 is a schematic diagram of a partial enlarged structure at part B in FIG. 12.
Figure 15:
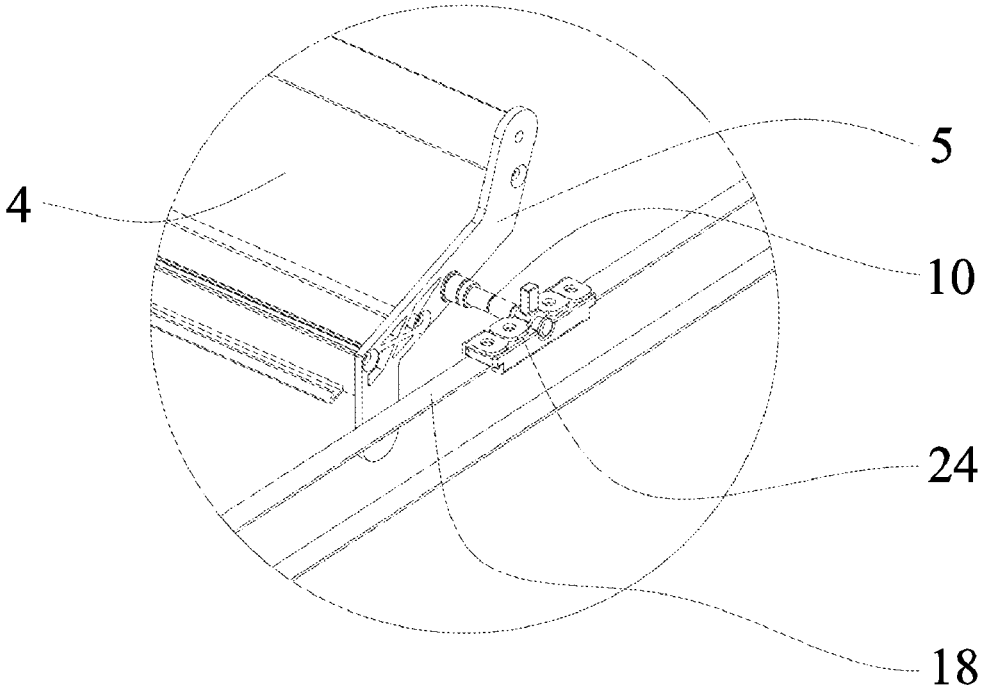
FIG. 15 is a schematic diagram of a partial enlarged structure at part C in FIG. 12.

In conjunction with FIG. 10 to FIG. 12, the first transmission shaft 14*a* is installed in cooperation with the driving wheel 17 in the first louver synchronous transmission mechanism through a first synchronous shaft 15*a*, the first transmission shaft 14*a* drives the first synchronous shaft 15*a* to rotate, and the first synchronous shaft 15*a* drives the driving wheel 17 in the first louver synchronous transmission mechanism to rotate; the second transmission shaft 14*b* is installed in cooperation with the driving wheel 17 in the second louver synchronous transmission mechanism through a second synchronous shaft 15*b*, the second transmission shaft 14*b* drives the second synchronous shaft 15*b* to rotate, and the second synchronous shaft 15*b* drives the driving wheel 17 in the second louver synchronous transmission mechanism to rotate; and the setting of the first synchronous shaft 15*a* and the second synchronous shaft 15*b* is optimized to facilitate the assembly and installation of the driving wheel 17 and realize the synchronous transmission output.

Combined with the above, in this example, the opening and closing operating principle of louver roof components is as follows: when the louver roof components change from a completely covering state to an open state, the servo control motor 13 rotates for an open state direction. The servo control motor 13 drives the first transmission shaft 14*a* and the second transmission shaft 14*b* through the first driving end 13*a* and the second driving end 13*b* respectively. The first transmission shaft 14*a* and the second transmission shaft 15*b* drive the driving wheel 17 located in the first louver synchronous transmission mechanism and the second louver synchronous transmission mechanism to rotate respectively through the first synchronous shaft 15*a* and the second synchronous shaft 15*b*. The driving wheel 17 drives the synchronous belt 18. The synchronous belt 18 moves along the axis of the long ring beam 2 due to the cooperation between the driving wheel 17 and the slave wheel 22. The synchronous belts 18 on both sides are respectively located on both sides of the louver roof components and cooperate with the rotation seats 24 on the synchronization belts 18 by a fixed setting in combination with the rotation axis 10 in each louver blade 4, so that each louver blade 4 can be closed from the free end 12 along the fixed end 11 through the synchronous belt 18. Combined with X-shaped change operation of the end covers 5 and the connecting sheets 6, the louver blades 4 gradually change from a horizontal state to a vertical state until the complete closure, so that the tent roof is opened.

When the louver roof components change from a completely open state to a covering state, the servo control motor 13 rotates for a close state direction and the servo control motor 13 realize reversal. The servo control motor 13 drives the first transmission shaft 14*a* and the second transmission shaft 14*b* through the first driving end 13*a* and the second driving end 13*b* respectively. The first transmission shaft 14*a* and the second transmission shaft 14*b* drive the driving wheel 17 located in the first louver synchronous transmission mechanism and the second louver synchronous transmission mechanism to rotate respectively through the first synchronous shaft 15*a* and the second synchronous shaft 15*b*. The driving wheel 17 drives the synchronous belt 18. The synchronous belt 18 moves reversely along the axis of the long ring beam 2 due to the cooperation between the driving wheel 17 and the slave wheel 22. The synchronous belts 18 on both sides are respectively located on both sides of the louver roof components and cooperate with the rotation seats 10 on the synchronization belts 18 by a fixed setting in combination with the rotation axis 10 in each louver blade 4, so that each louver blade 4 can be closed from the fixed end 11 along the free end 12 through the synchronous belt 18. Combined with X-shaped change operation of the end covers 5 and the connecting sheets 6, the louver blades 4 gradually change from a vertical state to a horizontal state until the complete covering, so that the louver blades 4 cover the tent roof.

In a preferred example, the driving wheel seats 19 are provided with driving wheel cavities, the driving wheel cavities are used to install the driving wheels 17, upper parts of the driving wheel cavities are further provided with anti-jump tooth parts 20, the anti-jump tooth parts 20 are provided with limit plates 21, and the limit plates 21 are covered with upper parts of the synchronous belts 18 cooperating with the driving wheels 17 in transmission. The anti-jump tooth parts 20 are optimized, and the limit plates 21 are used to cover the upper parts of the synchronous belts 18, so that the synchronous belts 18 can avoid jumping with the continuous transmission of the driving wheel 17, and the transmission stability can be increased.

Figure 16:
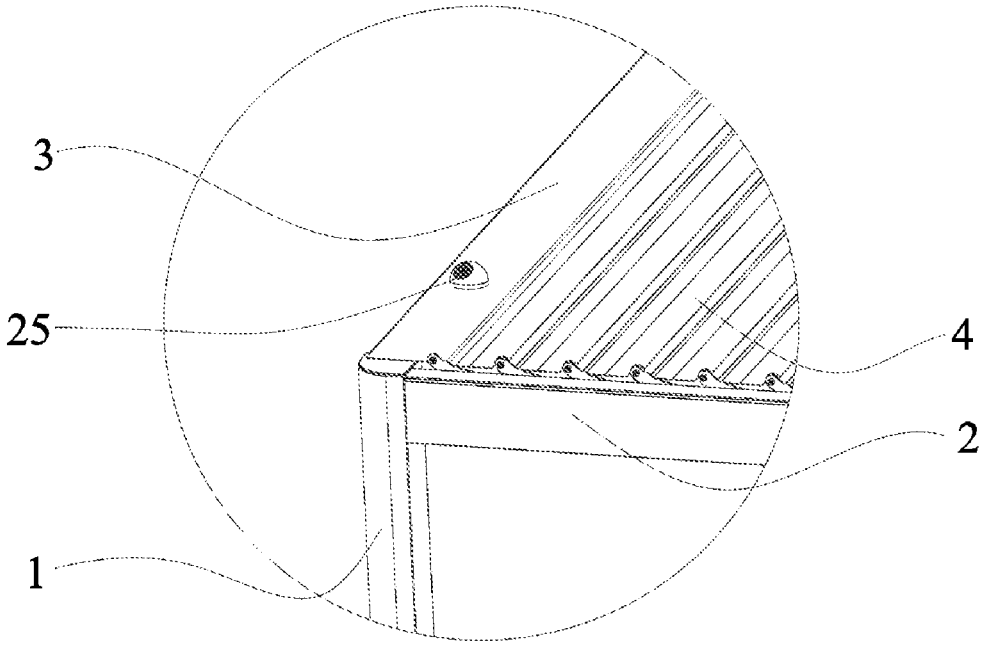
FIG. 16 is a schematic diagram of an installation structure of a rain sensor in the present invention.

In one preferred embodiment, as shown in FIG. 16, a rain sensor 25 is further comprised. The rain sensor 25 is used to collect rainwater information and transmit a collected signal to the controller of the servo control motor 13. The controller drives the servo control motor 13 according to the signal transmitted by the rain sensor 25 to realize the closure of the tent roof. The rain sensor 25 is optimized. The rain sensor 25 adopts a common sensor in the prior art to detect humidity and rain in the environment. In the process of data detection, through wire or wireless signal transmission technology, it realizes signal connectivity with the controller in the servo control motor 13. Combined with the environmental changes, the covering closure of louver blades 4 in the louver roof components can be realized.

The above are only preferred embodiments of the present invention and are not intended to limit the present invention in any form. Any simple modifications, equivalent changes, or modifications made to the above examples in accordance with the technical principle of the present invention still fall within the scope of the technical solution of the present invention.

The invention claimed is:

1. A tent comprising:

foot tubes;

two long ring beams and two short ring beams, all of which are supported by the foot tubes and define a roof cavity of the tent;

louver roof arrangement for the roof cavity, comprising:

louver blades each have two ends;

end covers fitted with the two ends of the louver blades, respectively;

connecting sheets each having two ends, one end of the two ends of each of the connecting sheets being directly and hingedly connected to an adjacent one of the end covers, the other end of the two ends of the each of the connecting sheets being directly and hingedly connected to another adjacent one of the end covers, and a point between the two ends of the each of the connecting sheets being hingedly connected to a respective one of the end covers to form a telescopic linkage to drive the louver blades to rotate, wherein when the end covers and the connecting sheets cooperate to expand, the louver blades rotate to expand horizontally along the two long ring beams to complete covering of the roof cavity, and wherein when the end covers and the connecting sheets cooperate to contract, the louver blades rotate to contract horizontally along the two long ring beams and toward one of the two short ring beams.

2. The tent of claim 1, wherein the end covers are hinged with middle parts of the respective connecting sheets so as to form collapsible cross structures.

3. The tent of claim 2, wherein the end covers and the middle parts of the respectively connecting sheets are provided with assembly holes, and rotating shafts penetrate through the assembly holes so that the end covers and the connecting sheets are hingedly connected.

4. The tent of claim 3, wherein each of the end covers has a Z shape.

5. The tent of claim 3, wherein the rotating shafts are further matched with rollers, the rollers are configured to be in slide fit with chutes disposed on the two long ring beams.

6. The tent of claim 1, wherein one end of the louver roof arrangement is fixed relative to one of the two short ring beams and the other end of the louver roof arrangement is movable.

7. The tent of claim 6, further comprising transmission members configured to linkage the end covers and the connecting sheets so as to achieve telescopic movement.

8. The tent of claim 7, wherein each of the transmission members comprises one of a synchronous belt, a chain, a screw rod, a linkage rod, or a rack.

9. The tent of claim 8, wherein the transmission members are driven by a hand worm, a motor, or a gas rod.

10. An apparatus comprising the tent of claim 1 and a motor driving mechanism.

11. The apparatus of claim 10, wherein the motor driving mechanism comprises a servo control motor, the servo control motor comprises a first driving end and a second driving end, wherein the first driving end is configured to cooperate with a first driving component, the second driving end is configured to cooperate with a second driving component.

12. A tent comprising:

foot tubes;

two long ring beams and two short ring beams, all of which are supported by the foot tubes and define a roof cavity of the tent;

louver roof components for the roof cavity, comprising:

louver blades each have two ends;

end covers fitted with the two ends of the louver blades; and connecting sheets hinged with the end covers, respectively, to drive the louver blades to rotate, wherein when the end covers and the connecting sheets cooperate to expand, the louver blades rotate to expand horizontally to complete covering of the roof cavity, and wherein when the end covers and the connecting sheets cooperate to contract, the louver blades rotate to contract horizontally toward one of the two short ring beams, a first driving component;

a second driving component;

a servo control motor comprising a first driving end configured to cooperate with the first driving component, and a second driving end configured to cooperate with the second driving component, wherein the first driving component comprises a first transmission shaft and a first louver synchronous transmission mechanism, the second driving component comprises a second transmission shaft and a second louver synchronous transmission mechanism, and wherein the first louver synchronous transmission mechanism and the second louver synchronous transmission mechanism respectively cooperate with the two long ring beams, wherein the first louver synchronous transmission mechanism and the second louver synchronous transmission mechanism each comprise a driving wheel, a slave wheel, and a synchronous belt moving with the driving wheel, and wherein the driving wheels are installed in the long ring beams adjacent to the one of the two short ring beams through driving wheel seats, the slave wheels are installed in the long ring beams adjacent to the other of the two short ring beams through slave wheel seats, the synchronous belts are coaxially arranged along the long ring beams, the synchronous belts are installed through rotating seats and rotating shafts in the louver blades, the rotating seats drive the louver blades with the movement of the synchronous belts to realize synchronous contraction for rotating or expansion for coverage.

13. The tent of claim 12, wherein the servo control motor is centrally installed on the one of the two short ring beams, and the first driving component and the second driving component are symmetrically arranged with respect to the servo control motor.

14. The tent of claim 13, further comprising a rain sensor configured to transmit a rain signal to a controller for the servo control motor, and the controller activates the servo control motor according to the rain signal transmitted by the rain sensor, so as to realize the closing of the roof cavity.

15. The tent of claim 13, wherein the first transmission shaft and the second transmission shaft are coaxially arranged along the one of the two short ring beams.

16. The tent of claim 12, wherein the driving wheel seats are provided with driving wheel cavities, the driving wheel cavities are used to install the driving wheels, upper parts of the driving wheel cavities are further provided with anti-jump tooth parts, the anti-jump tooth parts are provided with limit plates, the limit plates are covered with upper parts of the synchronous belts cooperating with the driving wheels in transmission.

17. The tent of claim 16, wherein the first transmission shaft is installed in cooperation with the driving wheel in the first louver synchronous transmission mechanism through a first synchronous shaft, the first transmission shaft drives the first synchronous shaft to rotate, the first synchronous shaft drives the driving wheel in the first louver synchronous transmission mechanism to rotate; and the second transmission shaft is installed in cooperation with the driving wheel in the second louver synchronous transmission mechanism through a second synchronous shaft, the second transmission shaft drives the second synchronous shaft to rotate, the second synchronous shaft drives the driving wheel in the second louver synchronous transmission mechanism to rotate.

* * * * *